US005725417A

United States Patent [19]

Robinson

[11] Patent Number: 5,725,417

[45] Date of Patent: Mar. 10, 1998

[54] METHOD AND APPARATUS FOR CONDITIONING POLISHING PADS USED IN MECHANICAL AND CHEMICAL-MECHANICAL PLANARIZATION OF SUBSTRATES

[75] Inventor: Karl M. Robinson, Boise, Id.

[73] Assignee: Micron Technology, Inc., Boise, Id.

[21] Appl. No.: 743,861

[22] Filed: Nov. 5, 1996

[51] Int. Cl.[6] ..... B24B 53/00

[52] U.S. Cl. ..... 451/56; 451/57; 451/287; 451/443

[58] Field of Search ..... 451/41, 56, 57, 451/285, 287, 288, 443, 444

[56] References Cited

U.S. PATENT DOCUMENTS

| | | | |
|---|---|---|---|
| 5,421,768 | 6/1995 | Fujiwara et al. | 451/288 |
| 5,433,650 | 7/1995 | Winebarger | 451/287 |
| 5,456,627 | 10/1995 | Jackson et al. | 451/57 |
| 5,480,476 | 1/1996 | Cook et al. . | |
| 5,486,131 | 1/1996 | Cesna et al. | 451/56 |
| 5,536,202 | 7/1996 | Appel et al. | 451/285 |
| 5,547,417 | 8/1996 | Breivogel et al. | 451/58 |
| 5,569,062 | 10/1996 | Karlsrud | 451/285 |
| 5,611,943 | 3/1997 | Cadien et al. | 451/444 |

*Primary Examiner*—Eileen P. Morgan
*Attorney, Agent, or Firm*—Seed and Berry LLP

[57] ABSTRACT

A method and apparatus for conditioning a planarizing surface of a polishing pad used to planarize a semiconductor wafer or other substrate. In one embodiment of the invention, a fixed-abrasive polishing pad having a suspension medium and a plurality of abrasive particles fixedly dispersed within the suspension medium, is conditioned by: forming a discreet stratum from the suspension medium at the surface of the planarizing surface; and removing the discreet stratum from the planarizing surface to form a newly exposed planarizing surface across the polishing pad. The suspension medium is preferably substantially insoluble in a wash fluid, while the discreet stratum is preferably soluble in the wash fluid. In a preferred embodiment, the discrete stratum is formed by diffusing a conditioning solution into the suspension medium that changes the suspension medium from being substantially insoluble in the wash fluid to being soluble in the wash fluid. The discreet stratum is then preferably removed from the planarizing surface by dissolving the discreet stratum in the wash fluid. Accordingly, the soluble stratum is selectively removed from the surface of the wafer to form a new, uniformly abrasive planarizing surface.

56 Claims, 4 Drawing Sheets

METHOD AND APPARATUS FOR CONDITIONING POLISHING PADS USED IN MECHANICAL AND CHEMICAL-MECHANICAL PLANARIZATION OF SUBSTRATES

TECHNICAL FIELD

The present invention is related to mechanical and chemical-mechanical planarization of semiconductor wafers and other substrates, and more particularly, to a method and apparatus for conditioning fixed-abrasive polishing pads.

BACKGROUND OF THE INVENTION

Chemical-mechanical planarization ("CMP") processes remove material from the surface of a semiconductor wafer in the production of integrated circuits. FIG. 1 schematically illustrates a CMP machine 10 with a platen 20, a wafer carrier 30, a polishing pad 40, and a planarizing liquid 44 on the polishing pad 40. The polishing pad 40 may be a conventional polishing pad made from a continuous phase matrix material (e.g., polyurethane), or it may be a new generation fixed-abrasive polishing pad made from abrasive particles fixedly dispersed in a suspension medium. The planarizing liquid 44 may be a conventional CMP slurry with abrasive particles and chemicals that remove material from the wafer, or the planarizing liquid 44 may be a planarizing solution without abrasive particles.

The CMP machine 10 also has an under-pad 25 attached to an upper surface 22 of the platen 20 and the lower surface of the polishing pad 40. A drive assembly 26 rotates the platen 20 (as indicated by arrow A), or it reciprocates the platen 20 back and forth (as indicated by arrow B). Other CMP machines orbit the platen 20 about a point, and still other CMP machines support the pad 40 on a linearly moving belt (not shown). Since the polishing pad 40 is attached to the under-pad 25, the polishing pad 40 moves with the platen 20.

The wafer carrier 30 has a lower surface 32 to which a wafer 12 may be attached, or the wafer 12 may be attached to a resilient pad 34 positioned between the wafer 12 and the lower surface 32. The wafer carrier 30 may be a weighted, free-floating wafer carrier; or an actuator assembly 36 may be attached to the wafer carrier to impart axial and/or rotational motion (as indicated by arrows C and D, respectively).

To planarize the wafer 12 with the CMP machine 10, the wafer carrier 30 presses the wafer 12 face-downward against the polishing pad 40. While the face of the wafer 12 presses against the polishing pad 40, at least one of the platen 20 or the wafer carrier 30 moves relative to the other to move the wafer 12 across the planarizing surface 42. As the face of the wafer 12 moves across the planarizing surface 42, material is continuously removed from the face of the wafer 12.

In the competitive semiconductor industry, it is desirable to consistently stop CMP processing of a run of wafers at a desired endpoint and to produce a uniform, planar surface on each wafer. Accurately stopping CMP processing at a desired endpoint is important to maintaining a high throughput of planarized wafers because the thickness of the planarized layer on the wafer must be within an acceptable range. It will be appreciated that if the thickness of the planarized layer is not within its acceptable range, the wafer must be re-planarized until it reaches a desired endpoint. Additionally, it is important to accurately produce a uniform, planar surface on each wafer to enable precise circuit and device patterns to be formed with photolithography techniques. The critical dimensions of many photo-patterns must be focused within a tolerance of approximately 0.1 μm. Focusing photo-patterns to such small tolerance, however, is difficult when the planarized surface of the wafer is not uniformly planar. Therefore, two primary objectives of CMP processing are stopping planarization at a desired endpoint and producing a highly uniform, planar surface on each wafer.

CMP processing involves many operating parameters that affect the planarity of the surface on the wafer and the ability to stop CMP processing at the desired endpoint. The condition of the planarizing surface of the polishing pad is one operating parameter that affects both the planarity and the ability to accurately endpoint a wafer. As a wafer is planarized, the condition of the planarizing surface of the polishing pad changes because waste matter accumulates on the planarizing surface. The problem of waste matter is particularly acute when planarizing doped silicon oxide layers because doping softens silicon oxide and makes it slightly viscous as it is planarized. The accumulations of doped silicon oxide glaze the planarizing surface of the polishing pad with a coating that substantially reduces the polishing rate over the glazed regions. As a result, non-uniformities in the condition of the planarizing surface make it difficult to estimate the processing time to stop at a desired end point and reduce the uniformity of the surface on the wafer. Therefore, it is desirable to "condition" the planarizing surface of the polishing pad to consistently provide a uniform surface for planarizing additional wafers.

Polishing pads are typically conditioned with an abrasive disk that removes the accumulations of waste matter and a thin layer of pad material. Conventional abrasive conditioning disks are generally embedded with diamond particles, and they are mounted to a separate actuator on a CMP machine that sweeps them across the polishing pad. Because typical abrasive disk pad conditioners remove a thin layer of the pad material in addition to the waste matter, they form a new, clean planarizing surface on the polishing pad. Some abrasive disk pad conditioners also use a liquid solution that dissolves some of the waste matter as the abrasive disks abrade the polishing surface.

Although conventional diamond-embedded abrasive disks are well suited to condition conventional polishing pads, they are not well suited to condition the new generation of fixed-abrasive polishing pads. Fixed-abrasive polishing pads have a planarizing surface with exposed abrasive particles, and the planarizing surface on some abrasive pads has a pattern of topographical features. When a fixed-abrasive polishing pad is conditioned with a diamond-embedded abrasive disk, the diamonds not only remove waste material, but they also remove some of the abrasive particles and damage the topographical features on the planarizing surface. Therefore, conventional pad conditioning processes and devices are not well suited to condition the new generation of fixed-abrasive polishing pads.

SUMMARY OF THE INVENTION

In one embodiment of the present invention, a fixed-abrasive polishing pad having a suspension medium and a plurality of abrasive particles fixedly dispersed within the suspension medium is conditioned by: forming a discreet stratum from the suspension medium at the surface of the planarizing surface; and removing the discreet stratum from the planarizing surface to form a newly exposed planarizing surface across the polishing pad. The suspension medium is preferably substantially insoluble in a wash fluid, while the discreet stratum is preferably soluble in the wash fluid. In a preferred embodiment, the discrete stratum is formed by diffusing a conditioning solution into the suspension medium that changes the suspension medium from being substantially insoluble in the wash fluid to being soluble in the wash fluid. The discreet stratum is then preferably removed from the planarizing surface by dissolving the discreet stratum in the wash fluid. Accordingly, the discrete stratum is selectively removed from the surface of the wafer to form a new, uniformly abrasive planarizing surface.

DETAILED DESCRIPTION OF THE INVENTION

The preferred embodiment of the present invention is a method for conditioning a fixed-abrasive polishing pad by removing material from the surface of the fixed-abrasive polishing pad. An important aspect of the preferred embodiment of the invention is to form a discrete stratum of soluble material from the suspension medium of the fixed-abrasive pad. The discrete stratum is preferably formed at a substantially uniform depth within the suspension medium across the surface of the pad. Another important aspect of the preferred embodiment of the invention is to remove the discrete stratum of soluble material from the planarizing surface with a wash fluid that leaves a newly exposed planarizing surface across the planarizing surface. FIGS. 2–5, in which like reference numbers refer to like parts throughout the various views, illustrate a conditioning device and a fixed-abrasive polishing pad being conditioned in accordance with a preferred embodiment of the invention.

Figure 1:
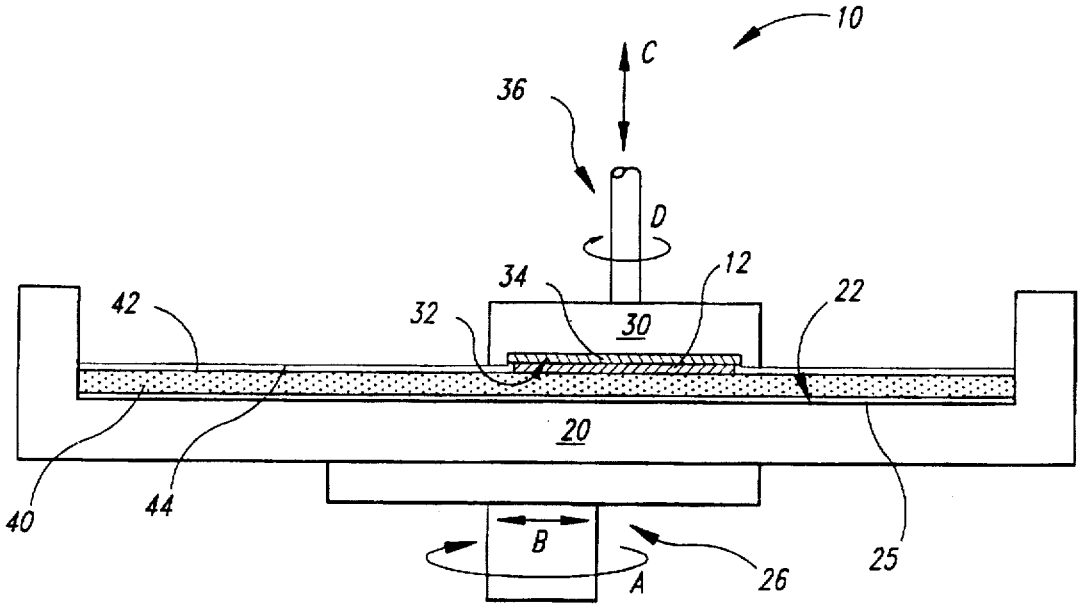
Fig. 1 (PRIOR ART)
FIG. 1 is a schematic cross-sectional view of a chemical-mechanical planarization machine in accordance with the prior art.
Figure 2:
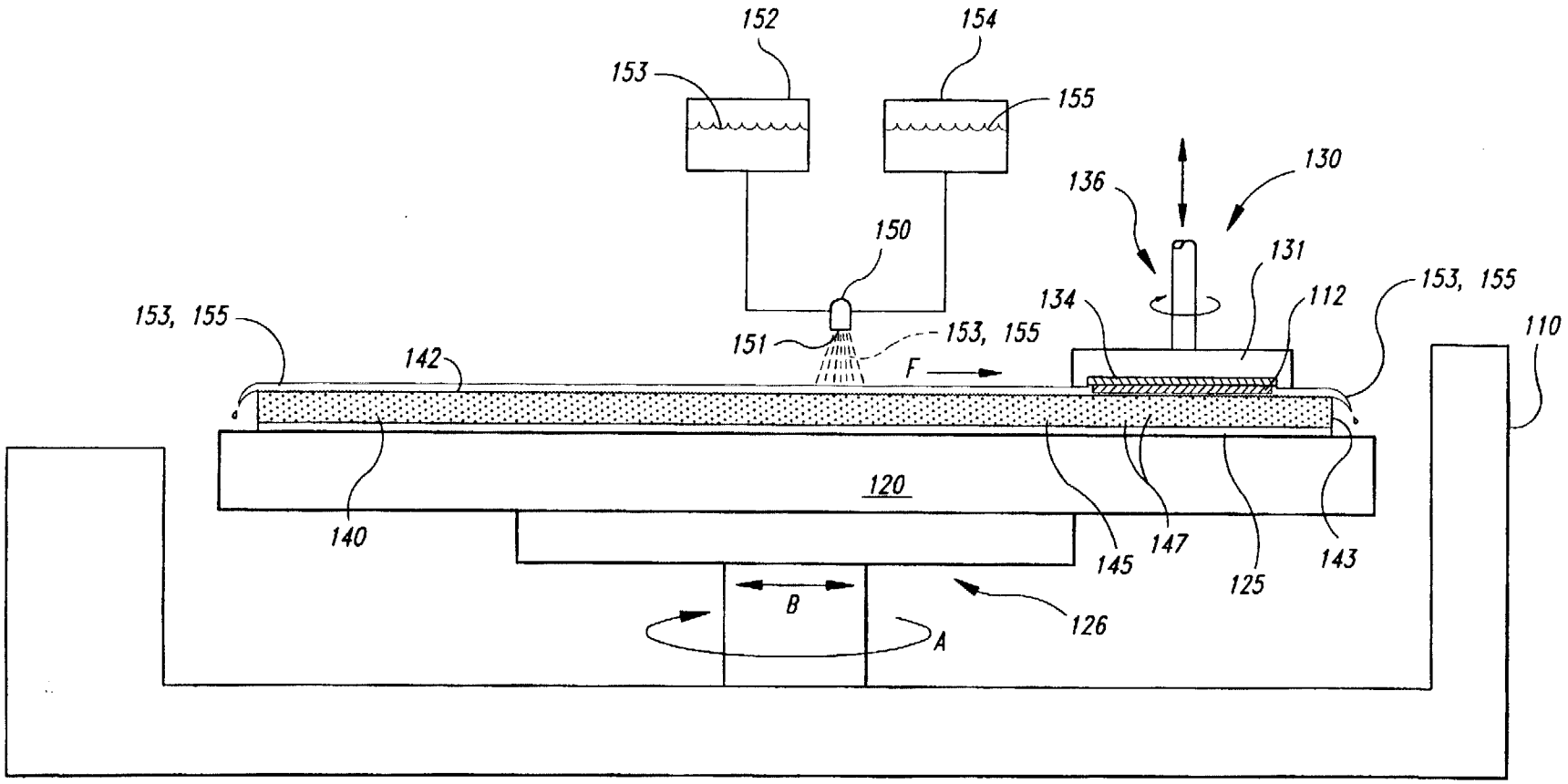
FIG. 2 is a schematic cross-sectional view of an embodiment of a chemical-mechanical planarization machine in accordance with the invention.

FIG. 2 is a schematic cross-sectional view of a preferred embodiment of a chemical-mechanical planarization machine 110 in accordance with the invention. The chemical-mechanical planarization machine 110 has a platen 120, an underpad 125 attached to the platen 120, a polishing pad 140 attached to the underpad 125, and a wafer carrier 130 positioned over the polishing pad 140. As discussed above with respect to FIG. 1, an actuator 126 moves the platen 120 and another actuator 136 moves a wafer holder 131 of the wafer carrier 130. The wafer 12 is mounted to a resilient backing pad 134 within the wafer holder 131, and the wafer carrier 130 moves the wafer 12 across the polishing pad 140 to planarize the front face 14 of the wafer 12.

The polishing pad 140 is preferably a fixed-abrasive polishing pad with a planarizing surface 142 facing the wafer 12 and an abrasive body 143 made from a suspension medium 145 and a plurality of finely divided abrasive particles 147 fixedly dispersed within the suspension medium 145. The suspension medium 145 is preferably insoluble in typical CMP planarizing solutions and wash fluids so that the body 143 does not dissolve in CMP processing. Suitable materials for use as a suspension medium 145 include, but are not limited to, urethanes and acrylates, as disclosed in U.S. Pat. No. 5,250,085. The abrasive particles 147 are small, hard particles that abrade the surface of the wafer 12. Suitable materials for the abrasive particles include, but are not limited to, aluminum oxides, silicon oxides and cerium oxides. Additionally, the planarizing surface 142 preferably has a plurality of exposed abrasive particles 148 and a pattern of topographical features 149.

The planarizing machine 110 also preferably has a conditioning solution dispenser 150 coupled to a first supply 152 of a conditioning solution 153 and a second supply 154 of a wash fluid 155. An opening 151 of the conditioning solution dispenser 150 is positioned over the polishing pad 140 to dispense the conditioning solution 153 or the wash fluid 155 onto the planarizing surface 142 of the polishing pad 140. As discussed in detail below, the conditioning solution 153 preferably interacts with the suspension medium 145 and forms a stratum (not shown in FIG. 2) of material that may be selectively removed from the planarizing surface 142 to condition the fixed-abrasive pad 140.

Figure 3:
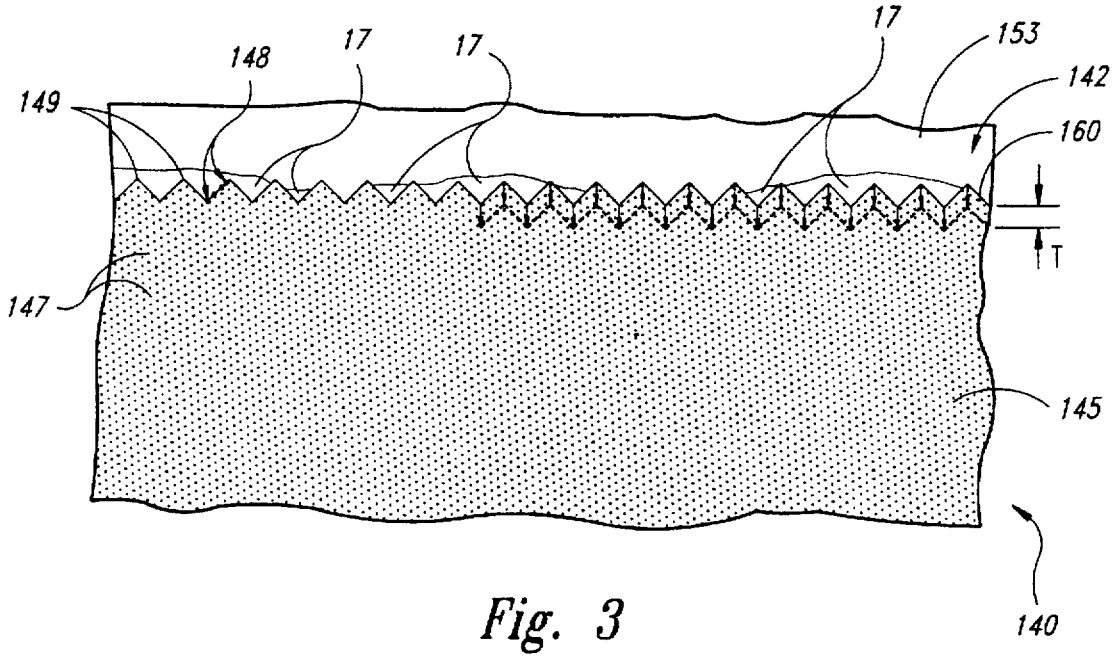
FIG. 3 is a partial schematic cross-sectional view of a fixed-abrasive polishing pad being conditioned in accordance with an embodiment of a method of the invention.

FIG. 3 is a partial cross-sectional view of the fixed-abrasive polishing pad 140 being conditioned in accordance with an embodiment of the invention. As discussed above, waste material 17 may accumulate on the planarizing surface 142 of the polishing pad 140 and cover the exposed abrasive particles 148 or the topographical features 149. The waste material 17 is generally residual material from the wafer (not shown), such as a glazed layer of polysilicon in the case of polysilicon CMP. Therefore, to provide a planarizing surface with consistent planarizing properties, it is generally desirable to remove the waste material 17 and a thin layer of the body 143 from the polishing pad 140.

To condition the polishing pad 140 in accordance with a preferred embodiment of the invention, the waste material 17 and a thin layer of the body 143 are removed from the polishing pad 140 by forming and then removing a discrete stratum 160 of material from the pad 140. The discrete stratum 160 is preferably a selectively removable material formed from the suspension medium 145 by changing the portion of the suspension medium 145 at the planarizing surface 142 from being substantially insoluble in the wash fluid 155 to being soluble in the wash fluid 155. More specifically, the discrete stratum 160 is preferably formed by coating the planarizing surface 142 with a conditioning solution 153 selected to diffuse into the suspension medium 145 and change the suspension medium 145 to a material that is soluble in the wash fluid 155. In a preferred embodiment (as shown in FIG. 2), the conditioning solution 153 is dispensed onto the planarizing surface 142 of the polishing pad 140 near the center of the polishing pad 140, and the centrifugal force generated by the platen 120 drives the conditioning solution 153 across the planarizing surface 142 (as indicated by F). As a result, a substantially uniform layer of conditioning solution 153 coats the planarizing surface 142 to diffuse uniformly into the suspension medium 145. The discrete stratum 160, therefore, is generally a sacrifice stratum that preferably has a substantially uniform thickness "T" across the planarizing surface 142 of the fixed-abrasive polishing pad 140.

The thickness T of the stratum 160 is controlled by empirically determining the diffusion rate of a particular conditioning solution 153 into a particular suspension medium 145. A desired thickness is preferably achieved by coating the planarizing surface 142 of the polishing pad with the conditioning solution 153 for a selected period of time according to the desired thickness of the stratum 160 and the diffusion rate of the conditioning solution 153. In general, the diffusion period is between approximately 5 and 300 seconds. It will be appreciated that the waste matter 17 may prevent the conditioning solution 153 from diffusing into the suspension medium 145. The conditioning solution 153, therefore, is preferably selected to quickly dissolve the waste matter 17 before it diffuses into the suspension medium 145. As a result, the conditioning solution 153 preferably does not diffuse into the exposed areas of suspension medium 145 to a significantly greater depth than under areas of the planarizing surface 142 coated with waste matter 17.

Figure 4:
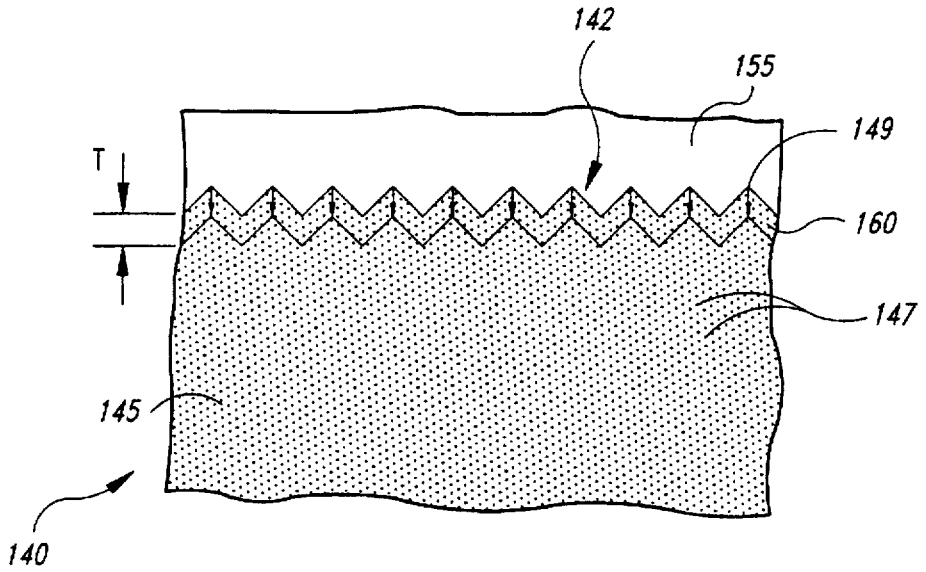
FIG. 4 is a partial schematic cross-sectional view of the fixed-abrasive polishing pad of FIG. 3 at another point in an embodiment of a method of the invention.

FIG. 4 is a partial schematic cross-sectional view of the fixed-abrasive pad 140 that illustrates the polishing pad 140 after the conditioning solution 153 (shown in FIG. 3) has diffused into the suspension medium 145 and formed the discrete stratum 160 of selectively removable material. In a preferred embodiment, the discreet stratum 160 is then removed from the polishing pad 140 by replacing the conditioning solution 153 with a wash fluid 155 that selectively dissolves the material of the discrete stratum 160. The wash fluid 155 is selected according to the solubility of the discreet stratum 160 and the suspension medium 145 to selectively dissolve the material of the discrete stratum 160 without dissolving the suspension medium 145. The wash fluid 155 is preferably dispensed onto the planarizing surface 142 through the dispenser 150 in the same manner as the conditioning solution 153, as described above with respect to FIG. 3. The wash fluid 155 preferably covers the discrete stratum 160 for a sufficient period of time to dissolve substantially all of the discrete stratum 160.

Figure 5:
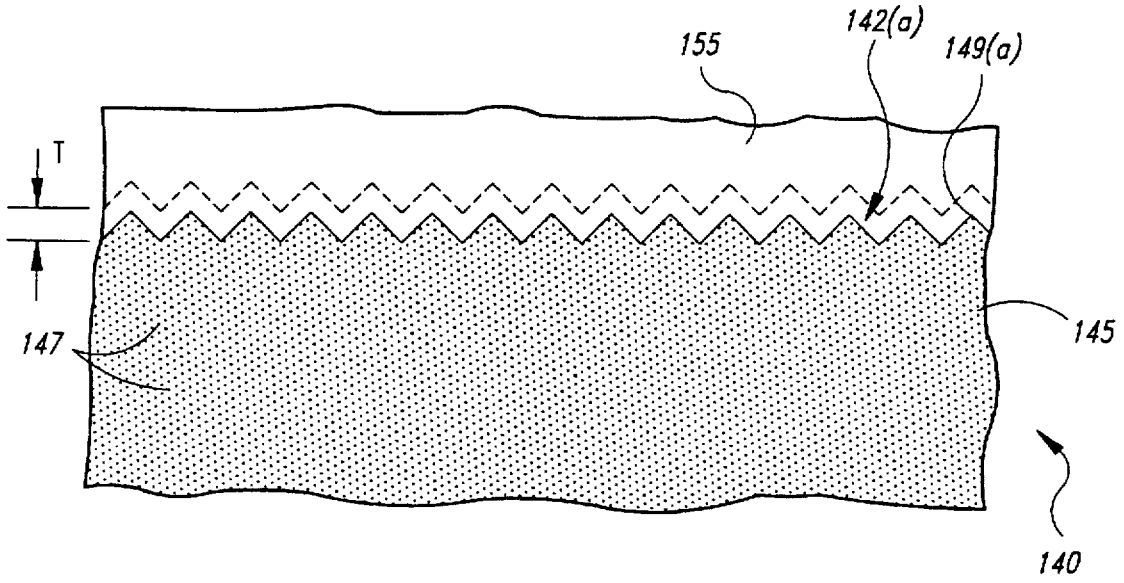
FIG. 5 is a partial schematic cross-sectional view of the polishing pad of FIGS. 3 and 4 at another point of an embodiment of a method of the invention.

FIG. 5 is a partial schematic cross-sectional view of the fixed-abrasive polishing pad 140 after the discrete stratum 160 has been removed by the wash fluid 155 to form a newly exposed planarizing surface 142(*a*). The new planarizing surface 142(*a*) preferably has topographical features 149(*a*) in substantially the same pattern and with substantially the same shape as the topographical features 149 on the original planarizing surface 142. The new planarizing surface also has a plurality of newly exposed abrasive particles 148(*a*). Therefore, the new planarizing surface 142(*a*) preferably has substantially the same planarizing properties as the original planarizing surface 142.

In a preferred embodiment of the invention, the suspension medium 145 of the polishing pad 140 is an acrylate or polyacrylate, and the conditioning solution 153 is a mild hydrochloric acid (HCl). As best shown by FIG. 3, the HCl conditioning solution 153 diffuses into the polyacrylate suspension medium 145 to a depth "d," and it changes the polyacrylate suspension medium 145 to a discrete stratum 160 of acrylic acid or polyacrylic acid with a substantially uniform thickness T across the planarizing surface 142. The polyacrylic acid discrete stratum 160 is soluble in deionized water, while the polyacrylate suspension medium 145 is insoluble in deionized water. Thus, the polyacrylic acid discrete stratum 160 is a selectively removable material formed from the polyacrylate suspension medium 145.

The wash fluid 155, therefore, is preferably deionized water. Accordingly, when a polyacrylate suspension medium 145 of a polishing pad is changed to a polyacrylic acid discrete stratum 160 with a mild HCl conditioning solution 153, the polyacrylic acid discrete stratum 160 formed on the planarizing surface 142 of the polishing pad 140 is simply dissolved in the wash fluid 155 of deionized water. It will be appreciated that once the discrete stratum 160 is fully dissolved in the wash fluid 155, the newly exposed surface on the polishing pad is protected from further removal because the suspension medium 145 is substantially insoluble in the wash fluid 155. In other embodiments, the wash fluid 155 may be an organic solvent, such as ethanol, isopropanol, or acetone.

Figure 6:
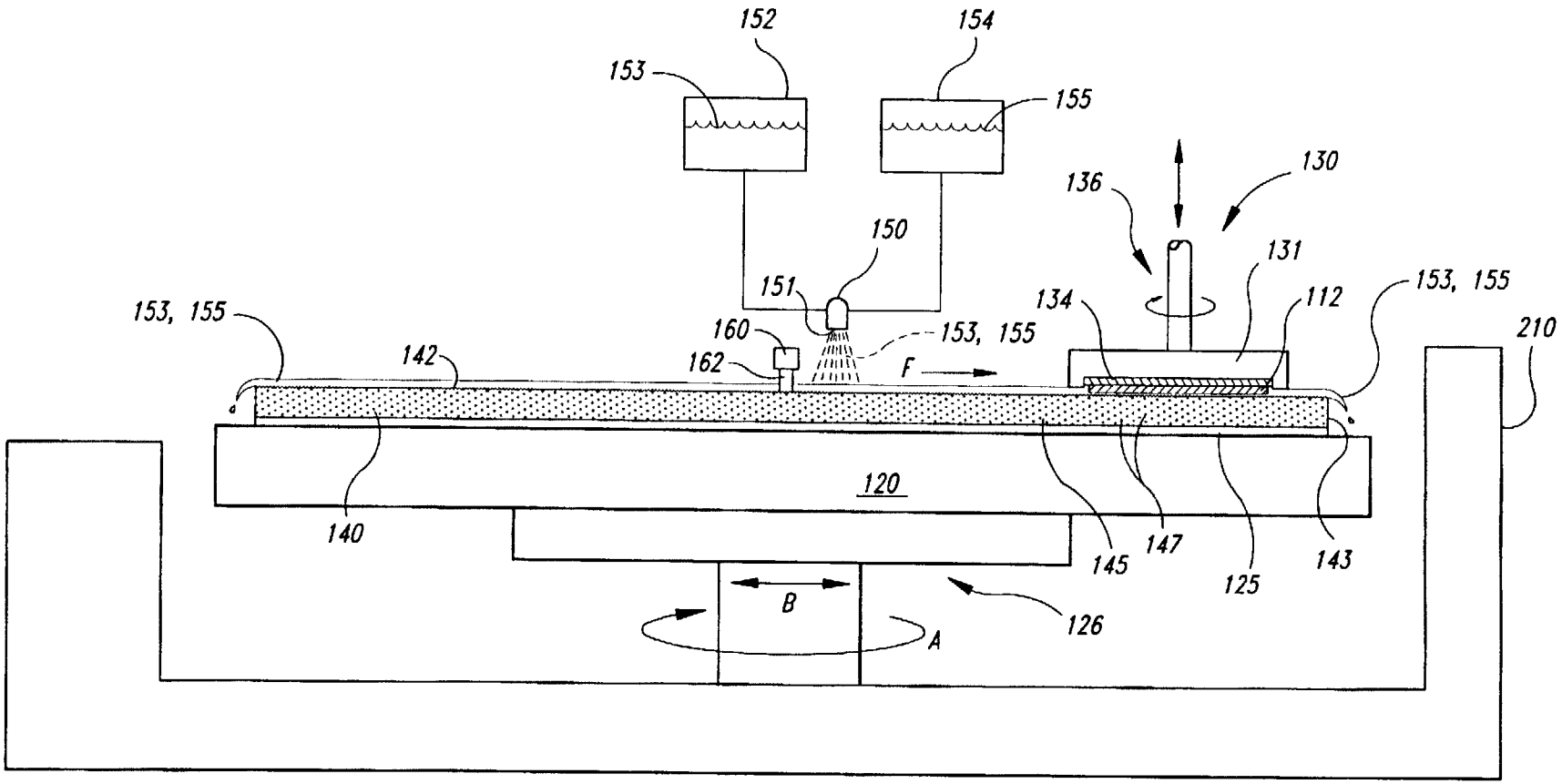
FIG. 6 is a schematic side view of an embodiment of another chemical-mechanical planarization in accordance with the invention.

FIG. 6 is a schematic side view of another embodiment of a chemical-mechanical planarization machine 210 in accordance with the invention. In addition to the structure shown and described above with respect to the planarization machine 110, the planarization machine 210 also has an arm 160 positioned over the polishing pad 140 and a mechanical cleaning element 162 attached to the arm 160. The mechanical cleaning element 162 may be a brush or other type of pad that engages the discreet stratum 160 (shown in FIG. 4) in the presence of the wash fluid 155 (also shown in FIG. 4) to enhance the removal of the discreet stratum 160 from the polishing pad. One suitable mechanical cleaning element 162 is shown in FIG. 5 of allowed U.S. patent application Ser. No. 08/574,678, entitled DIRECTIONAL PAD SPRAY SCRUBBER, and filed on Dec. 19, 1995, which is herein incorporated by reference. Accordingly, an embodiment of a method of the invention may also include mechanically and chemically removing the discreet stratum 160 from the planarizing surface 142 of the polishing pad 140.

An advantage of a preferred embodiment of the present invention is that it provides a planarizing surface with consistent planarizing properties from one wafer to another that improves the ability to stop CMP processing at a desired endpoint. By forming a discrete stratum of selectively removable material from the polishing pad material, and by controlling the thickness of the discrete stratum, a uniform layer of material may be removed from the surface of the polishing pad to form a new planarizing surface. It will be appreciated that the newly formed surface preferably has the same planarizing characteristics as the original planarizing surface. For example, a topography of groove lines or other features fabricated on the planarizing surface is maintained from one conditioning cycle to another. Accordingly, the preferred embodiment of the present invention provides a planarizing surface that produces a substantially consistent polishing rate from one wafer to another.

Another advantage of the preferred embodiment of the present invention is that it consistently provides a substantially uniform polishing rate across the polishing pad. By removing the discrete stratum from the polishing pad, the wafer material is also removed from the polishing pad. As a result, the newly formed planarizing surface is preferably devoid of waste matter and preferably has a substantially uniform polishing rate. Therefore, the preferred embodiment of the invention also improves the uniformity of the planarized surface on the wafer.

From the foregoing it will be appreciated that, although specific embodiments of the invention have been described herein for purposes of illustration, various modifications may be made without deviating from the spirit and scope of the invention. In other embodiments of the invention, for example, different suspension media may be used to form the body of the polishing pad, different conditioning solutions may be used to form the discrete stratum of selectively removable material from the particular suspension medium, and different wash fluids may be used to selectively remove the particular material of a discrete stratum. In accordance an embodiment of the invention, fixed-abrasive and non-abrasive polishing pads may be conditioned by forming a discrete stratum of selectively removable material from a layer of material at the planarizing surface of the polishing pads, and then selectively removing the discrete stratum from the polishing pads. Also, even though the various embodiments of the invention are described as being used for planarizing semiconductor wafers, it will be understood that they are equally applicable to planarizing other types of substrates (e.g., baseplates for field emission displays). Accordingly, the invention is not limited except as by the appended claims.

I claim:

1. A method for conditioning a planarizing surface of a polishing pad having a body with a planarizing surface, the method comprising the steps of:

forming a discrete stratum from the body at the planarizing surface of the polishing pad, the discrete stratum being soluble in a wash fluid in which the body is otherwise substantially insoluble; and removing the discrete stratum from the polishing pad with the wash fluid leaving a newly exposed planarizing surface across the polishing pad.

2. The method of claim 1 wherein the polishing pad is an abrasive polishing pad in which the body has a suspension medium and a plurality of abrasive particles fixedly suspended within the suspension medium, and wherein the forming step comprises making the discrete stratum from the suspension medium and abrasive particles.

3. The method of claim 2 wherein the forming step comprises coating the planarizing surface with a conditioning solution that transforms a layer of the suspension medium from being substantially insoluble in the wash fluid to being soluble in the wash fluid.

4. The method of claim 3 wherein the suspension medium comprises an organic compound that is insoluble in water and the conditioning solution changes the organic compound to be soluble in water, and wherein the coating step comprises dispensing the conditioning solution onto the planarizing surface.

5. The method of claim 3 wherein the suspension medium comprises a polyacrylate, and wherein the coating step comprises dispensing hydrochloric acid on the planarizing surface that changes the polyacrylate into a polyacrylic acid to form the discrete stratum of a polyacrylic acid soluble in water.

6. The method of claim 5 wherein the removing step comprises washing the polyacrylic acid discrete stratum with water after the coating step.

7. The method of claim 3 wherein the forming step further comprises leaving the conditioning solution on the planarizing surface for a diffusion period during which the conditioning solution diffuses into the polishing pad to a desired depth that defines a desired thickness of the discrete stratum.

8. The method of claim 7 wherein the suspension medium is a polyacrylate and the conditioning solution is hydrochloric acid having a concentration of 0.01%–10% HCl, and wherein the leaving step comprises removing the hydrochloric acid from the planarizing surface between approximately 5 and 300 seconds after coating the planarizing surface.

9. The method of claim 8 wherein the conditioning solution is hydrochloric acid having a concentration of approximately 1% HCl.

10. The method of claim 2 wherein the forming step comprises diffusing a transformation solution into the polishing pad that interacts with an upper portion of the suspension medium and forms a surface stratum soluble in water.

11. The method of claim 10 wherein the suspension medium is a polyacrylate, and wherein the diffusing step comprises coating the polishing pad with hydrochloric acid.

12. The method of claim 11 wherein the diffusion step further comprises leaving the hydrochloric acid on the polyacrylate suspension medium for a period in which the hydrochloric acid diffuses into the planarizing surface to a desired depth that defines a desired thickness of the discrete stratum.

13. The method of claim 11 wherein the removing step comprises washing the hydrochloric acid from the planarizing surface.

14. The method of claim 1 wherein the wash fluid comprises an inorganic solvent.

15. The method of claim 14 wherein the wash fluid comprises ethanol.

16. The method of claim 14 wherein the wash fluid comprises isopropanol.

17. The method of claim 14 wherein the wash fluid comprises acetone.

18. A method for preparing the surface of a fixed-abrasive polishing pad for use in mechanical and chemical-mechanical planarization of a semiconductor substrate, the fixed-abrasive polishing pad having a body including a suspension medium and a plurality of abrasive particles fixedly dispersed within the suspension medium, the method comprising the steps of:

altering a property of a portion of the body to form a sacrificial stratum having a composition different than that of the body, the sacrificial stratum being formed at a planarizing surface of the fixed-abrasive polishing pad; and selectively removing the sacrificial stratum from the fixed-abrasive polishing pad leaving a newly exposed planarizing surface across the body.

19. The method of claim 18 wherein the forming step comprises coating the planarizing surface with a conditioning solution that transforms a layer of the suspension medium from being substantially insoluble in a wash fluid to being substantially soluble in the wash fluid.

20. The method of claim 19 wherein the suspension medium comprises a polyacrylate, and wherein the forming step comprises coating the planarizing surface with a conditioning solution that transforms the polyacrylate material of the suspension medium from being substantially insoluble in water to being substantially soluble in water.

21. The method of claim 19 wherein the suspension medium comprises a polyacrylate, and wherein the forming step comprises coating the planarizing surface with hydrochloric acid that transforms the polyacrylate material of the suspension medium into a polyacrylic acid, and the removing step comprises washing the polyacrylic acid discreet stratum with deionized water after the coating step.

22. A method for conditioning a planarizing surface of a polishing pad, the method comprising the steps of:

coating the planarizing surface with a conditioning solution that transforms material of the polishing pad from being insoluble in a wash fluid to being soluble in the wash fluid;

leaving the conditioning solution on the planarizing surface for a diffusion period during which the conditioning solution diffuses into the polishing pad and forms a soluble stratum at the planarizing surface; and dispensing the wash fluid onto the soluble stratum to remove the soluble stratum from the polishing pad.

23. The method of claim 22 wherein the polishing pad is a fixed-abrasive polishing pad having a body of a suspension medium and a plurality of abrasive particles fixedly dispersed within the suspension medium, and wherein the coating and leaving steps form the soluble stratum from the suspension medium.

24. The method of claim 22 wherein the polishing pad is a fixed-abrasive polishing pad having a body with a polyarylate suspension medium and a plurality of abrasive particles fixedly suspended within the polyacrylate suspension medium, and wherein the coating step comprises dispensing a hydrochloric acid on the surface of the planarizing surface to form the soluble stratum of polyacrylic acid.

25. The method of claim 24 wherein the step of dispensing the wash fluid comprises dissolving the polyacrylic acid soluble stratum with deionized water.

26. The method of claim 22 wherein the conditioning solution diffuses into the polishing pad to a desired thickness.

27. A method for conditioning a planarizing surface of a fixed-abrasive polishing pad having a suspension medium and a plurality of abrasive particles fixedly dispersed within the suspension medium, the suspension medium being substantially insoluble in a wash compound, wherein the method comprises the steps of:

diffusing a transformation solution into the polishing pad at the planarizing surface to interact with a layer of the polishing pad adjacent to the planarizing surface and form a surface stratum soluble in the wash compound across the polishing pad; and dissolving the surface stratum with file wash compound.

28. The method of claim 27 wherein the diffusing step comprises coating the planarizing surface with the transformation solution and leaving the transformation solution on the planarizing surface for a diffusion period during which the transformation solution diffuses into the suspension medium to a desired thickness.

29. The method of claim 27 wherein the diffusion step comprises coating the planarizing surface with the transformation solution and leaving the transformation solution on the planarizing surface for a period of between approximately 5 and 300 seconds after coating the planarizing surface.

30. The method of claim 27 wherein the suspension medium comprises a polyacrylate and the transformation solution comprises a hydrochloric acid, and wherein the diffusion step comprises coating the planarizing surface with the hydrochloric acid conditioning solution to transform a layer of the polyacrylate suspension medium to a polyacrylic acid surface stratum soluble in deionized water.

31. The method of claim 28 wherein the wash compound comprises deionized water, and wherein the dissolving step comprises dispensing deionized water onto the polyacrylic acid surface stratum.

32. A method for planarizing a semiconductor substrate, the method comprising the steps of:

pressing the substrate against a planarizing surface of a polishing pad;

moving at least one of the substrate and the pad with respect to the other to impart relative motion therebetween and to remove material from the substrate;

separately forming a discrete stratum from a layer of material of the polishing pad at the planarizing surface to have a first composition different than a second composition of a remaining portion of the polishing pad; and selectively removing the discrete stratum from the planarizing surface to expose a conditioned planarizing surface.

33. The method of claim 32 wherein the polishing pad is a fixed-abrasive polishing pad having a body with a suspension medium and a plurality of abrasive particles fixedly suspended within the suspension medium, and wherein the forming step comprises making the discrete stratum from the suspension medium.

34. The method of claim 33 wherein the forming step comprises coating the planarizing surface with a conditioning solution that transforms a layer of material of the suspension medium from being substantially insoluble in the wash fluid to being soluble in the wash fluid.

35. The method of claim 33 wherein the suspension medium comprises an organic compound substantially insoluble in water and the conditioning solution changes the organic compound to be soluble in water, and wherein the coating step comprises dispensing the conditioning solution on the planarizing surface.

36. The method of claim 33 wherein the suspension medium comprises a polyacrylate, and wherein the coating step comprises dispensing hydrochloric acid on the planarizing surface that changes a layer of the polyacrylate into a discrete stratum of polyacrylic acid soluble in water.

37. The method of claim 36 wherein the removing step comprises washing the polyacrylic acid discrete stratum with water after the coating step.

38. A method for mechanically and chemically-mechanically planarizing a semiconductor substrate, the method comprising the steps of:

pressing the substrate against a planarizing surface of a polishing pad having a suspension medium that is substantially insoluble in a wash fluid;

moving at least one of the substrate and the pad with respect to the other to impart relative motion therebetween and to remove material from the substrate;

coating the planarizing surface with a conditioning solution that transforms the suspension medium from being substantially insoluble in the wash fluid to being substantially soluble in the wash fluid;

leaving the conditioning solution on the planarizing surface for a diffusion period during which the conditioning solution diffuses into the suspension medium and forms a soluble stratum at the planarizing surface; and dispensing the wash fluid onto the soluble stratum to selectively remove the soluble stratum and expose a conditioned planarizing surface.

39. The method of claim 38, further comprising removing the substrate from the pad prior to the coating step.

40. The method of claim 38 wherein the suspension medium comprises a polyacrylate and the conditioning solution comprises a hydrochloric acid, and wherein the coating and leaving steps comprise diffusing the hydrochloric acid conditioning solution into the polyacrylate suspension medium to form a soluble stratum of polyacrylic acid soluble in water.

41. The method of claim 40 wherein the wash fluid comprises water.

42. The method of claim 38 wherein the conditioning solution diffuses into the suspension medium to a desired thickness.

43. A method for planarizing a semiconductor substrate, the method comprising the steps of:

pressing the substrate against a planarizing surface of a fixed-abrasive polishing pad having a suspension medium and a plurality of abrasive particles fixedly dispersed within the suspension medium;

moving at least one of the substrate and the fixed-abrasive pad with respect to the other to impart relative motion therebetween and to remove material from the substrate;

diffusing a transformation solution into the polishing pad to interact with a layer of the suspension medium and form a surface stratum soluble in a wash compound; and dissolving the surface stratum with the wash compound.

44. The method of claim 43 wherein the diffusing step comprises coating the planarizing surface with the transformation solution and leaving the transformation solution on the planarizing surface for a diffusion period during which the transformation solution diffuses into the suspension medium to form the soluble surface stratum.

45. The method of claim 43 wherein the suspension medium comprises a polyacrylate and the transformation solution comprises a hydrochloric acid, and wherein the diffusion step comprises coating the planarizing surface with the hydrochloric acid conditioning solution that forms a surface stratum of polyacrylic acid soluble in water.

46. The method of claim 45 wherein the wash compound comprises water, and wherein the dissolving step comprises dispensing the wash compound onto the polyacrylic acid surface stratum.

47. A planarization machine for planarizing a microelectronic wafer substrate, comprising:

a platen mounted to a support structure;

a polishing pad having a body with a planarizing surface;

a wafer carrier in which the microelectronic wafer substrate may be mounted, the wafer carrier being adapted to engage the microelectronic wafer substrate with the planarizing surface of the polishing pad, and at least one of the platen and the wafer carrier being adapted to move with respect to the other to impart relative motion therebetween when the microelectronic wafer substrate is engaged with the planarizing surface; and a dispenser operatively coupled to a supply of conditioning solution that changes a layer of material of the polishing pad into a discrete stratum at the planarizing surface that is selectively removable from the polishing pad to expose a new planarizing surface on the body, the dispenser having an opening positioned over the polishing pad to deposit the conditioning solution onto the polishing pad.

48. The planarizing machine of claim 47 wherein the body of the polishing pad comprises a suspension medium and a plurality of abrasive particles fixedly suspended within the suspension medium.

49. The planarizing machine of claim 47 wherein the body of the polishing pad comprises a suspension medium and a plurality of abrasive particles fixedly suspended within the suspension medium, the suspension medium being substantially insoluble in water and the discrete stratum being substantially soluble in water.

50. The planarizing machine of claim 47 wherein the body of the polishing pad comprises a polyacrylate suspension medium and a plurality of abrasive particles fixedly suspended within the polyacrylate suspension medium, and the discrete stratum comprises a thin layer of polyacrylic acid formed from the polyacrylate suspension medium.

51. The planarizing machine of claim 47 wherein the dispenser is also operatively coupled to a supply in which the discrete stratum is soluble.

52. The planarizing machine of claim 47, further comprising a mechanical cleaning element positioned over the planarizing surface of the polishing pad, the mechanical cleaning element being adapted to be engaged with the planarizing surface to enhance removal of the discreet stratum from the polishing pad.

53. A planarizing machine for planarizing a substrate, comprising:

a platen mounted to a support structure;

a polishing pad having a body with a planarizing surface;

a substrate carrier in which the substrate may be mounted, the substrate carrier being adapted to engage the substrate with the planarizing surface of the polishing pad, and a least one of the platen and the substrate carrier being adapted to move with respect to the other to impart relative motion therebetween when the substrate is engaged with the planarizing surface;

a dispenser operatively coupled to a supply of conditioning solution that changes a layer of material of the polishing pad into a discrete stratum at the planarizing surface that is selectively removable from the polishing pad to expose a new planarizing surface on the body, the dispenser having an opening positioned over the polishing pad to deposit the conditioning solution onto the polishing pad; and a mechanical cleaning element positioned over the planarizing surface of the polishing pad, the mechanical cleaning element being adapted to be engaged with the planarizing surface to enhance removal of the discreet stratum from the polishing pad.

54. The machine of claim 53 wherein the mechanical cleaning element comprises a brush.

55. A method for conditioning a planarizing surface of a polishing pad having a body and a planarizing surface, the method comprising the steps of:

forming a discrete stratum from the body at the planarizing surface of the polishing pad, the discrete stratum being soluble in a wash fluid in which the body is otherwise substantially insoluble; and removing the discrete stratum from the polishing pad with the wash fluid and a mechanical cleaning element leaving a newly exposed planarizing surface across the polishing pad.

56. The method of claim 55 wherein the removing step comprises brushing the discrete stratum with a brush in the presence of the wash fluid.

* * * * *